US010321763B2

(12) United States Patent
Bonneywell

(10) Patent No.: US 10,321,763 B2
(45) Date of Patent: Jun. 18, 2019

(54) CHAIR

(71) Applicant: Boss Design Limited, West Midlands (GB)

(72) Inventor: David Stephen Bonneywell, West Midlands (GB)

(73) Assignee: Boss Design Limited, West Midlands (GB)

( * ) Notice: Subject to any disclaimer, the term of this patent is extended or adjusted under 35 U.S.C. 154(b) by 118 days.

(21) Appl. No.: 14/801,127

(22) Filed: Jul. 16, 2015

(65) Prior Publication Data

US 2016/0015179 A1 Jan. 21, 2016

(30) Foreign Application Priority Data

Jul. 17, 2014 (GB) ..... 1412733.6
Apr. 14, 2015 (GB) ..... 1506323.3

(51) Int. Cl.

| | |
|---|---|
| ***A47C 3/026*** | (2006.01) |
| ***A47C 7/44*** | (2006.01) |
| ***A47C 1/024*** | (2006.01) |
| ***A47C 3/025*** | (2006.01) |
| ***A47C 7/14*** | (2006.01) |

(52) U.S. Cl.

CPC ..... *A47C 3/026* (2013.01); *A47C 1/024* (2013.01); *A47C 3/0252* (2013.01); *A47C 7/14* (2013.01); *A47C 7/44* (2013.01)

(58) Field of Classification Search

None

See application file for complete search history.

(56) References Cited

U.S. PATENT DOCUMENTS 3,598,354 A * 8/1971 Williams ..... A47C 3/026 248/353
3,669,399 A * 6/1972 Wager ..... A47C 3/026 248/575
4,429,917 A 2/1984 Diffrient
4,911,501 A 3/1990 Decker et al.

(Continued)

FOREIGN PATENT DOCUMENTS

DE 29711329 U1 8/1997
DE 29802360 U1 6/1999

(Continued)

OTHER PUBLICATIONS

Search and examination report for GB1412733.6 dated Jan. 12, 2015.

(Continued)

*Primary Examiner* — David E Allred

(74) *Attorney, Agent, or Firm* — Levenfeld Pearlstein, LLC

(57) ABSTRACT

A chair comprises a backrest, a seat, a supporting structure for supporting the backrest and the seat, and a base support. The supporting structure, the seat and the backrest are each pivotably mounted to permit the supporting structure, the seat and the backrest to each tilt over a predetermined range. This allows the chair to move into and out of a reclined position. The seat is free to pivot over its predetermined range relative to the supporting structure independently of a tilt of the supporting structure. The pivoting backrest and the pivoting seat are intended to encourage dynamic sitting.

20 Claims, 18 Drawing Sheets

(56) References Cited

U.S. PATENT DOCUMENTS 5,080,318 A * 1/1992 Takamatsu ..... A47C 3/026 248/598
5,121,934 A * 6/1992 Decker ..... A47C 1/03255 297/300.1
5,150,948 A 9/1992 Voelkle
5,267,777 A * 12/1993 Valtri ..... A47C 3/026 297/302.1
5,582,459 A 12/1996 Hama et al.
5,871,256 A 2/1999 Kogai
5,871,258 A * 2/1999 Battey ..... A47C 1/023 297/300.2
6,116,687 A 9/2000 Vogtherr
6,869,142 B2 * 3/2005 Heidmann ..... A47C 1/03255 297/300.1
6,880,886 B2 * 4/2005 Bodnar ..... A47C 7/28 297/285
6,932,430 B2 * 8/2005 Bedford ..... A47C 7/28 297/285
6,935,962 B1 8/2005 Tseng
7,048,335 B2 * 5/2006 Norman ..... A47C 1/023 297/300.1
7,857,390 B2 * 12/2010 Schmitz ..... A47C 1/03255 297/300.1
8,029,060 B2 * 10/2011 Parker ..... A47C 1/023 297/300.1
8,061,767 B2 * 11/2011 Kunzler ..... A47C 3/025 297/196
8,087,727 B2 * 1/2012 Parker ..... A47C 1/023 297/300.2
9,033,421 B2 * 5/2015 Wilkinson ..... A47C 1/03 297/440.11
2002/0149247 A1 10/2002 Diffrient
2007/0222265 A1 9/2007 Machael
2015/0173515 A1 * 6/2015 Freedman ..... A47C 7/024 297/314

FOREIGN PATENT DOCUMENTS

EP 1163865 A2 12/2001
EP 1872688 A1 1/2008
EP 2946694 A1 11/2015
GB 1276274 A 6/1972
GB 2414391 A 11/2005
WO 0067615 A1 11/2000
WO 2010041518 A1 4/2010
WO 2013131753 A1 9/2013

OTHER PUBLICATIONS

European Search Report in EP 15177024.5 dated Nov. 27, 2015.
Search and Examination Report in GB 1506323.3 dated Sep. 28, 2015.
Combined Search and Examination Report issued by IPO in connection with GB1506323.3 dated Sep. 28, 2015.
Examination Report issued by IPO in connection with GB1506323.3 dated May 29, 2018.
Examination Report issued by IPO in connection with GB1506323.3 dated Aug. 9, 2017.

* cited by examiner

CHAIR

BACKGROUND

The present invention relates to a chair and, in particular but not exclusively, to a chair of the kind used in an office environment.

Over recent years, office working practices have evolved. 'Knowledge-based' workers are no longer based at the same desk each day and the workplace is becoming more focused on collaboration in order to drive innovation across multi-disciplinary platforms. Offices are evolving to become a place where workers 'touch-down' for shorter periods of time, and where 'hot-desking' is becoming the norm in a range of businesses. Whereas once every employee had their own desk and their own chair, businesses are now under pressure to gain greater efficiencies by increasing the ratio of people to desks, therefore eliminating the need for banks of desks that may previously have been only partially filled at any given time.

From a seating perspective, the traditional 'eight-hour' (i.e. full working day), fully-ergonomic, manually adjusted task chair is no longer required in every case. However, providing a smaller number of desks and chairs, for use by a variety of different people at different times may be problematic. Physical characteristics such as height, weight, build, posture etc. vary from person to person. A chair that would be comfortable for a tall person of heavy build may not be suitable for a shorter, leaner person. Typically, office chairs are manually adjustable such that a person can vary the chair settings to a set-up that is comfortable for them. This may involve manually adjusting the height of the seat above the ground, or the inclination of the backrest. However, if a chair is being used by a number of different people in a 'hot desk' environment, each person will either need to adjust the chair each time they use it after someone else, or they will endure using a chair that has been used by someone else, even though their settings may be inappropriate leading to discomfort and potential injury.

U.S. Pat. No. 4,429,917 by Diffrient discloses a tilting-type chair including a base, a seat, and a back. The back of the U.S. Pat. No. 4,429,917 chair is fixedly connected to a frame of the chair and cannot swivel relative to the frame. In U.S. Pat. No. 4,429,917, a mechanism effects that the seat and the back both tilt in a ratio of about 1 to 3, to prevent that only the back tilts or that the seat and back tilt as a unit.

WO 00/67615 by Bujaryn describes a chair comprising a seat pan and an armrest support pivotably attached to a mounting assembly comprising a lower and an upper rail. The potential maximum rearward tilt of the seat pan is limited by the tilt of the mounting assembly, and if the mounting assembly is not fully titled, the seat pan cannot achieve its maximum rearward tilt.

The subject of U.S. 2007/0222265 A1 by Machael is an adjustable reclining chair in which a force applied onto a back-upright of a chair is re-directed by the back-upright to lift the seat assembly. The seat assembly cannot pivot independently.

The present invention has been devised with the foregoing in mind.

SUMMARY

According to the present invention there is provided a chair. The chair provides a combination of independent pivoting movements which work together to adapt to a user whilst still allowing the complete chair to move into and out of a reclined position.

Advantageously, embodiments of the chair of the present invention caters for the new way of working discussed above, by offering more comfort and support than a meeting chair whilst still being dynamic. Embodiments of the invention allow the body to move like it does in a task chair, but without the plethora of manual adjustments traditionally found on a task chair.

In an embodiment, the chair comprises a backrest, a seat, a supporting structure for supporting the backrest and/or the seat and a base support, wherein the supporting structure, the seat and the backrest are each pivotably mounted to permit the supporting structure, the seat and the backrest to each tilt over a predetermined range, to allow the chair to move into and out of a reclined position. The seat is free to pivot over its predetermined range relative to the supporting structure independently of any tilt of the supporting structure. In an embodiment, the backrest is free to pivot over its predetermined range relative to the supporting structure independently of any tilt of the supporting structure. Preferably the supporting structure is pivotably mounted with respect to the base support, the seat is pivotably mounted with respect to the supporting structure and the backrest is pivotably mounted with respect to the supporting structure.

In an embodiment, the chair further comprises a seat tilt mechanism that permits the seat to pivot about a pivot point and with respect to the base support such that the seat is tiltable between a first limit in a first direction and a second limit in a second and opposite direction, the first limit and the second limit defining the predetermined range of the seat. The seat tilt mechanism may comprise a component for regulating or dampening the motion and return of the seat during tilting. Preferably, the component is or comprises a pre-tensioned or resiliently deformable component that is deformable when the seat is tilted in one or each direction. The component may be or comprise a spring steel member, a spring, an elastomeric member, or a hydraulic dampener. The first and second limits may be defined by stop positions on the supporting structure. In an embodiment, the seat is tiltable from a neutral position at substantially 0° to the first limit of approximately +5° and to the second limit of approximately −5°.

In an embodiment, the chair further comprises a backrest tilt mechanism that permits the backrest to pivot about a pivot point with respect to the supporting structure such that the backrest is tiltable between a first limit in a first direction and a second limit in a second and opposite direction, the first limit and the second limit defining the predetermined range of the backrest. Preferably, the backrest tilt mechanism comprises a component for regulating or dampening the motion and return of the backrest during tilting. The component may be or comprise a pre-tensioned or resiliently deformable component that is deformable when the backrest is tilted in one or each direction. Preferably, the component is or comprises a spring steel member, a spring, an elastomeric member, or a hydraulic dampener. The first and second limits may be defined by stop positions on the supporting structure. The backrest may be tiltable from a neutral position to the first limit of approximately −12°.

In another embodiment, the chair further comprises a tilt mechanism that permits the supporting structure to pivot about a pivot point with respect to the base support such that the supporting structure is tiltable between a first limit in a first direction and a second limit in a second and opposite direction, the first limit and the second limit defining the predetermined range of the supporting structure. The tilt mechanism may comprise a component for regulating or dampening the motion and return of the backrest during tilting. The component may be or comprise a pre-tensioned or resiliently deformable component that is deformable when the backrest is tilted in one or each direction. The component may be or comprise a spring steel member, a spring, an elastomeric member, or a hydraulic dampener. The component may be one or more compression springs. The first and second limits may be defined by one or more buffers provided within the tilt mechanism. The supporting structure may be tiltable from a neutral position (approximately 0°) to the first limit of approximately −9°.

DESCRIPTION OF THE DRAWINGS

Embodiments of the invention will now be described with reference to the following drawings, in which.

DETAILED DESCRIPTION

Figure 1:
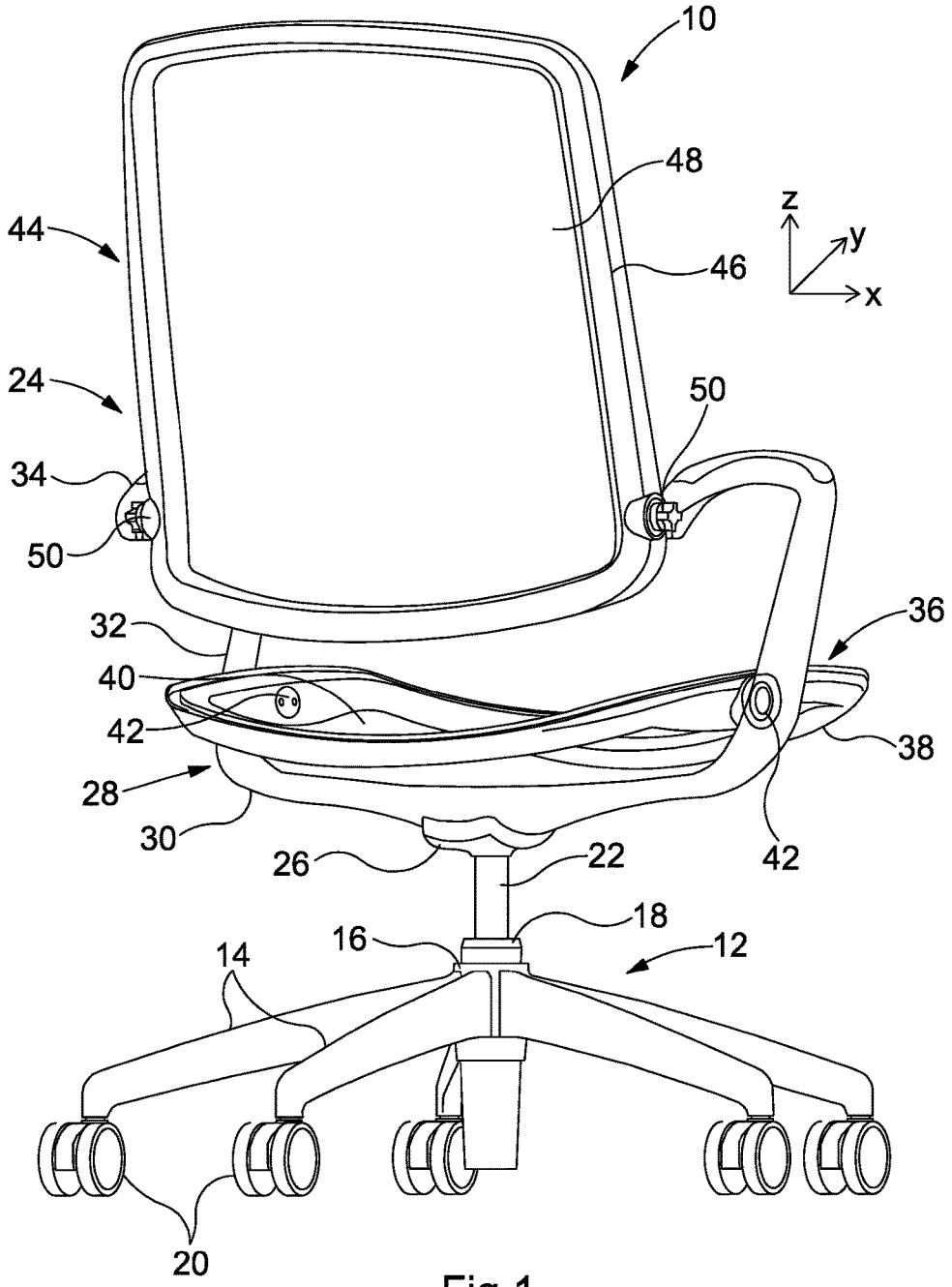
FIG. 1 is a rear perspective view of a chair according to an embodiment of the present invention.
Figure 2B:
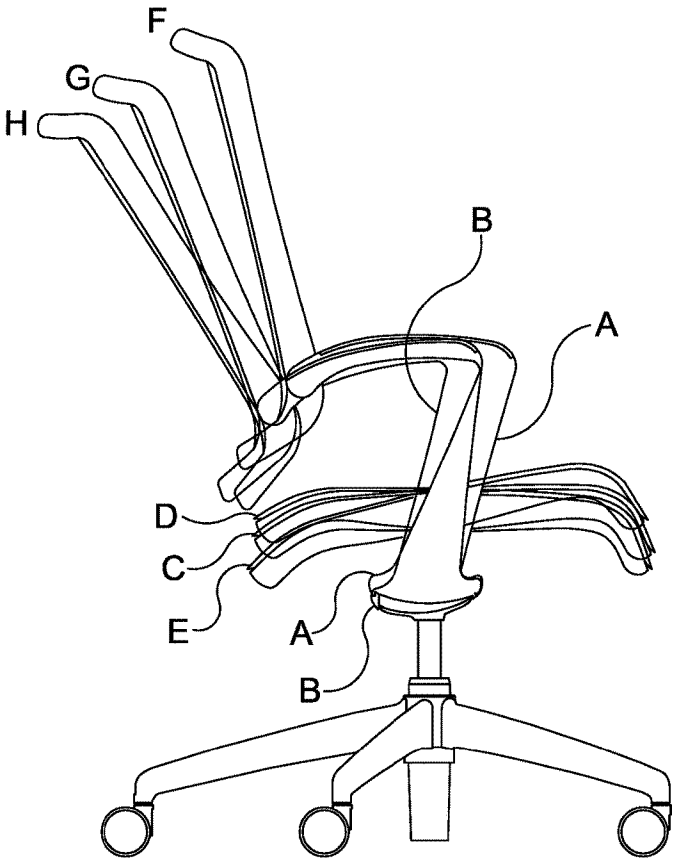
FIG. 2*b* is a side view of the chair of FIG. 1, illustrating the range of movement of the backrest, seat and cradle.
Figure 2A:
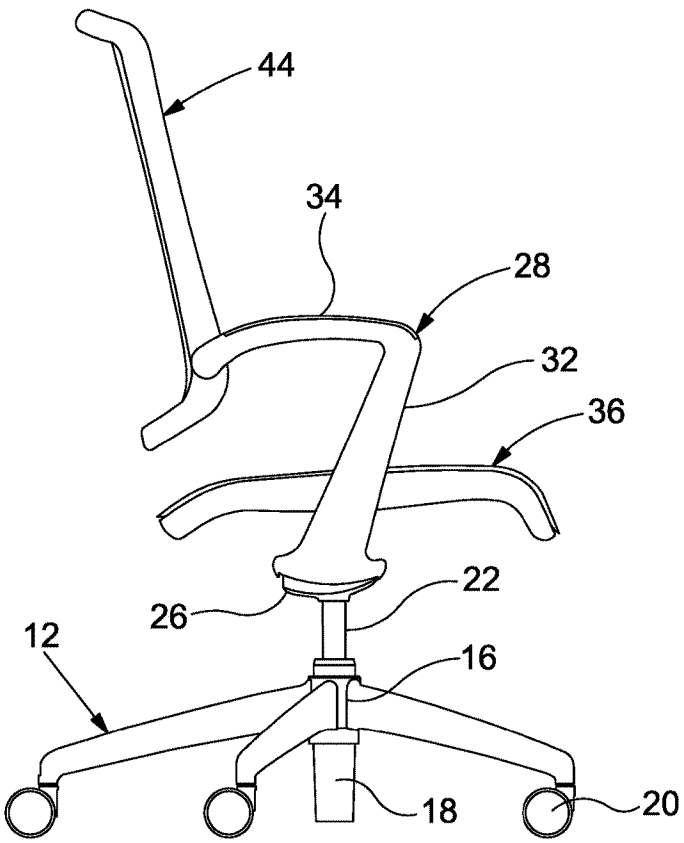
FIG. 2*a* is side view of the chair of FIG. 1.

FIGS. 1 and 2*a* show a chair 10 according to an embodiment of the present invention. The chair 10 has a base 12 comprising a plurality of legs 14. In the embodiment shown there are five legs provided equally spaced around the centre of the base. The legs 14 extend radially away from a central sleeve 16 that surrounds and is coupled to an inner sleeve or receptacle 18. The other end of each leg 14 comprises a castor 20. The inner sleeve (gas lift) 18 is configured to receive a first end of vertical member or shaft 22, the other (second) end of which is coupled to a seat assembly 24, which will be discussed in greater detail below. The shaft 22 may be rotatably mounted within the sleeve 18 so as to permit rotating/swivelling movement between the seat assembly 24 and the base 12. The central shaft 22 is connected to the outer sleeve 18 via a bearing ring and is prevented from being pulled out of the top by a locking washer on the underside thereof. The gas lift 18 is connected to the base 12 via a morse taper of 1°.

The second end of the shaft 22 is received within a support 26 that forms a base for the seat assembly 24. The support 26 also houses a 'tilt mechanism' that enables a pivoting or rocking movement of the seat assembly 24 with respect to the shaft 22 and base 12. To the support 26 is attached a supporting structure or cradle 28. Two cradle base arms 30 are coupled to the base support 26, on opposite sides thereof. Each cradle arm 30 extends laterally outwardly with respect thereto, in opposing directions (in the x direction of FIG. 1), and then transitions into a more upright portion 32 (that extends in the y direction, and at an angle in the y-z plane), before returning substantially in the y direction) to form an armrest 34.

The seat assembly 24 further comprises a seat 36 comprising a frame 38 and seat pad 40. The seat assembly 36 is attachable to the cradle 28 at fixing locations 42. The height of the seat 36 is adjusted manually via a small 'seat height pull' lever (19 as shown in FIG. 7*c*) under the cradle 28. The range of adjustment is, in an example, substantially 120 mm taking the seat height from substantially 400 to 520 mm from the floor. It will be appreciated that other seat heights are possible.

The seat assembly 24 also comprises a backrest 44, which itself also comprises a frame 46 and a pad 48. Each of the ends of the cradle arms 34 is connectable to the backrest at fixing locations 50.

FIG. 2*b* illustrates the movement combinations that are possible in the embodiment described above.

Figure 3B:
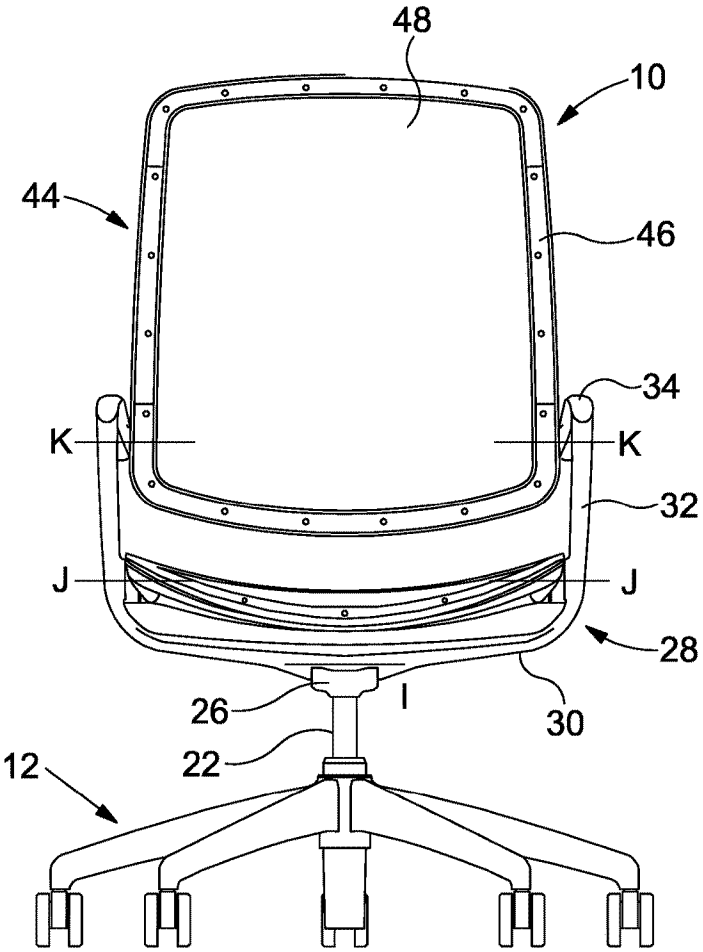
FIGS. 3*a*, 3*b* and 3*c* are side, front and top views respectively, showing the pivot points for providing the movement ranges illustrates in FIG. 2*b;*
Figure 3A:
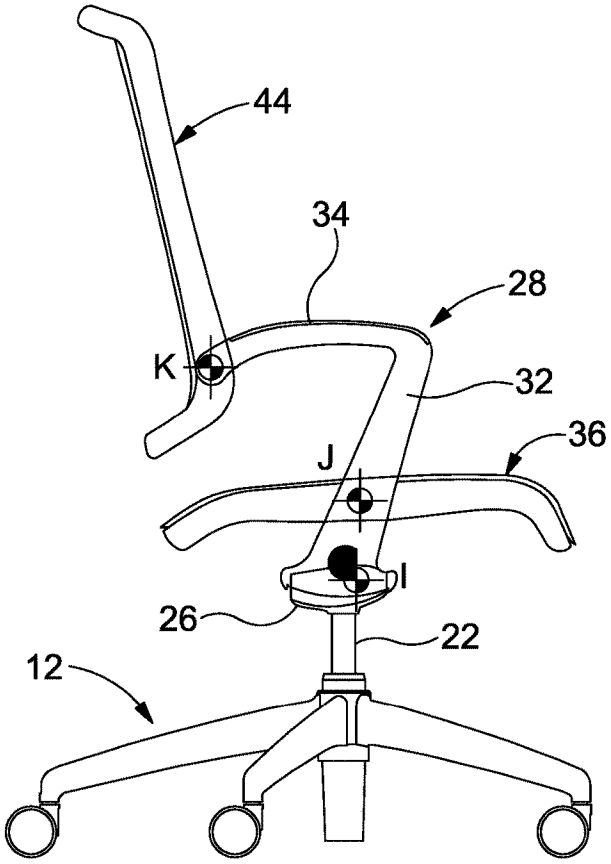
Figure 3C:
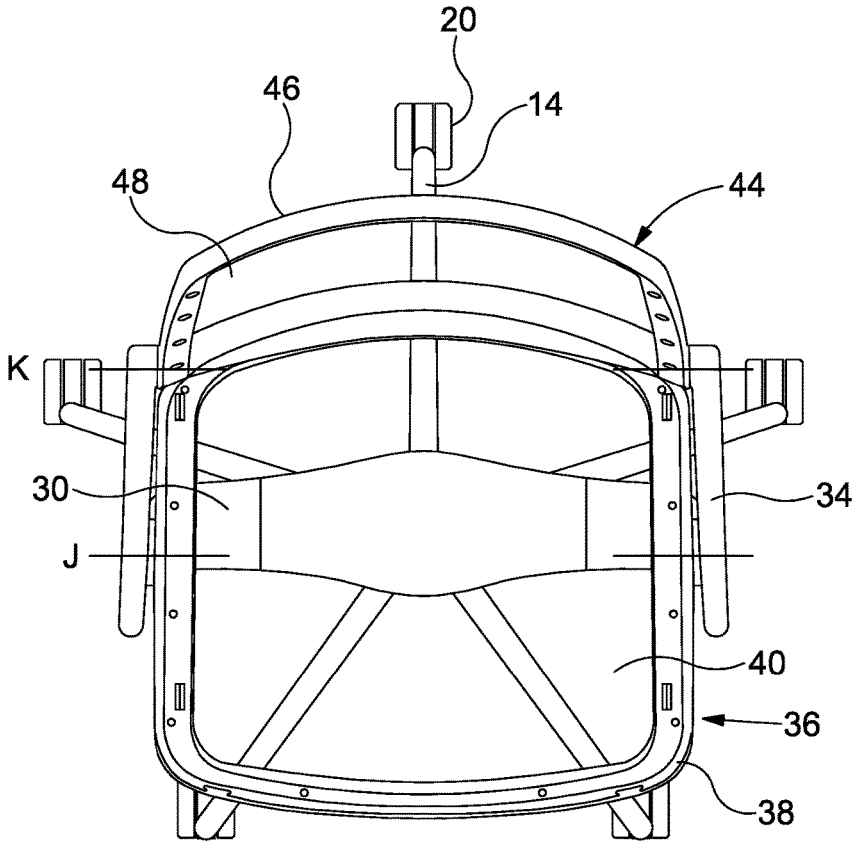
Figure 6:
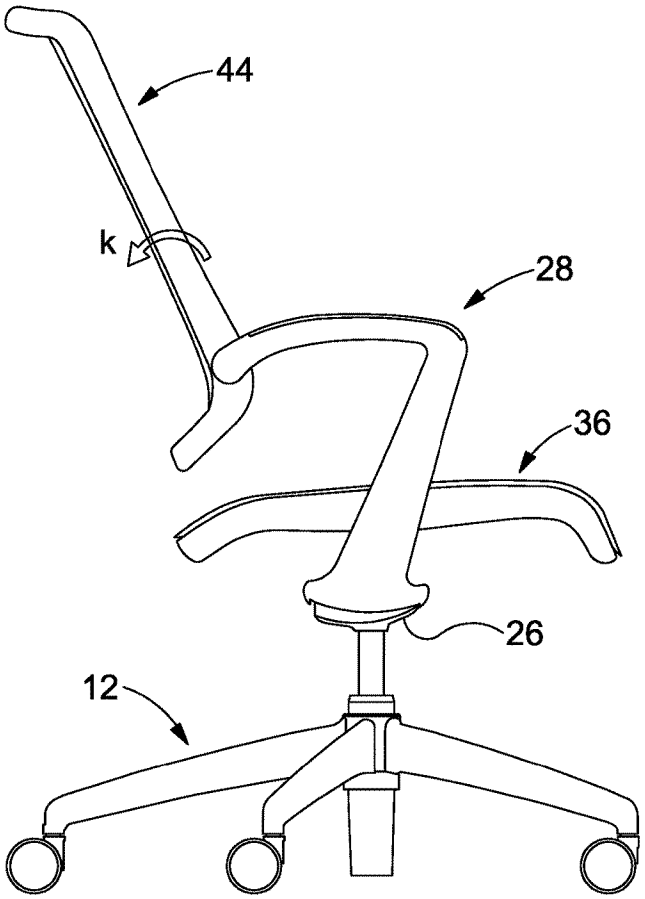
FIG. 6 illustrates the backrest movement.
Figure 4:
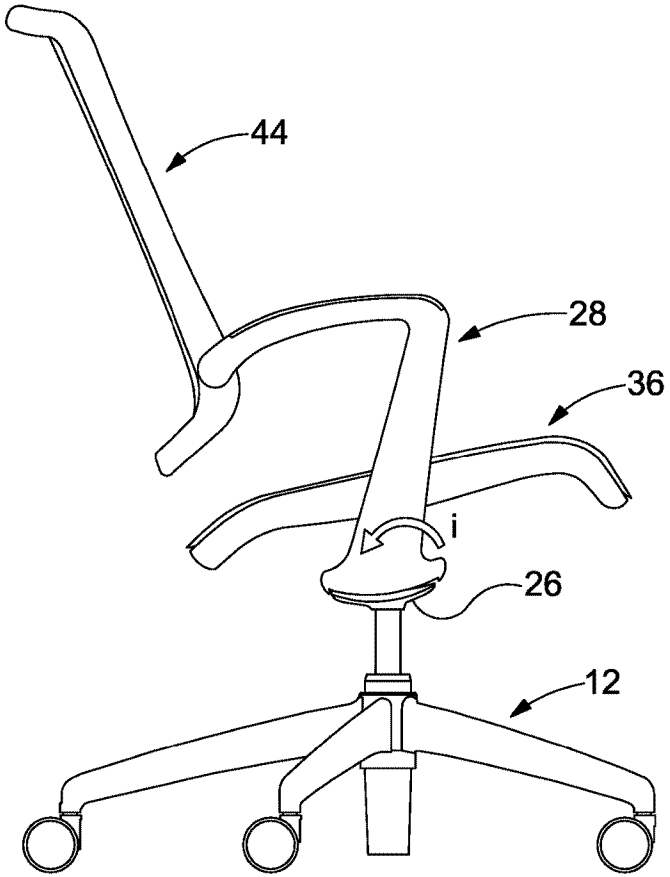
FIG. 4 illustrates the cradle movement.
Figure 5B:
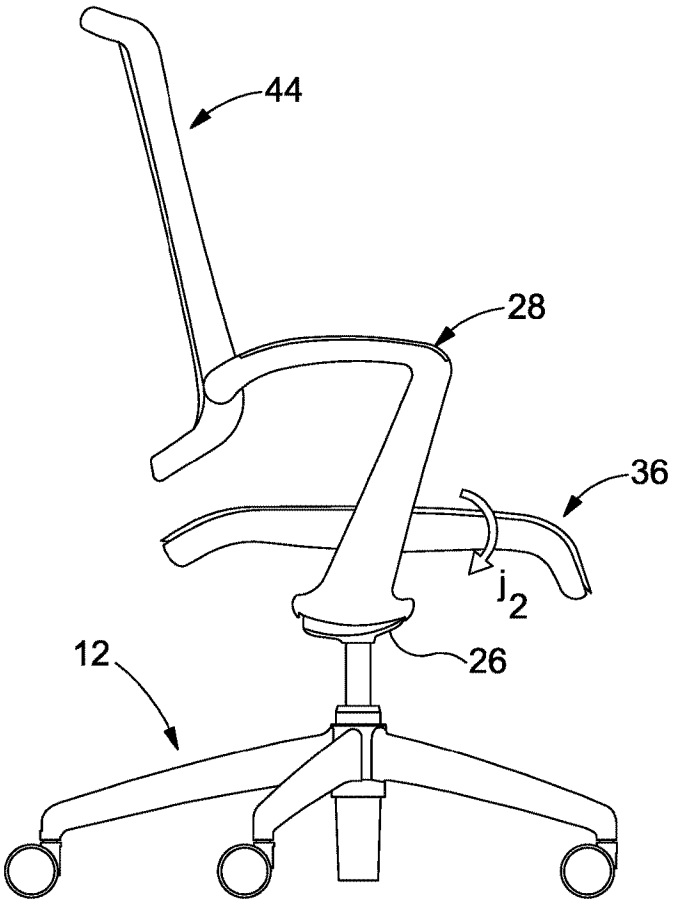
FIGS. 5*a* and 5*b* illustrate the seat movement.
Figure 5A:
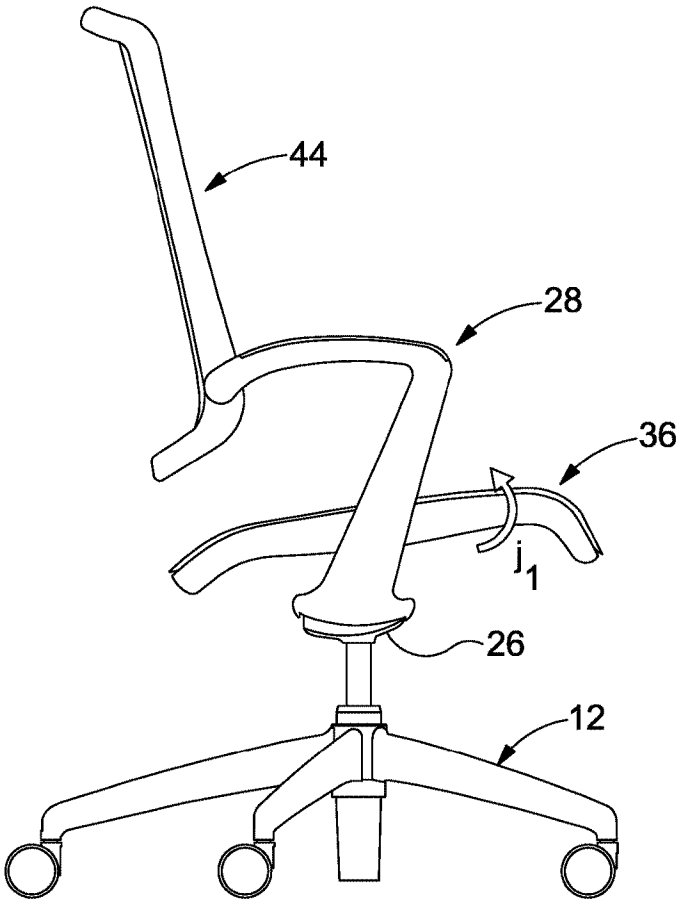

In a neutral (or starting) position, e.g. before a person sits on the chair 10, the cradle 28 is in position 'A', the seat 36 is in position 'C' and the backrest is in position 'F'. As can be seen in FIGS. 3*a* to 3*c*, the cradle 28 is pivoted with respect to the shaft 22 and base 12 at pivot point 'I', the seat 36 is pivoted with respect to the cradle 28 at pivot points J and the backrest 44 is pivoted with respect to the cradle 28 at pivot points 'K'. In the embodiment shown, and with reference to FIGS. 2*b* and 3*a* to 3*c*, the cradle 28 can rotate about pivot point 'I' from the natural position 'A' to the reclined position 'B'. The seat 36 can rotate about pivot point J from neutral position 'C' to the reclined position 'E' in one direction and to the inclined position 'D' in the other. The backrest 44 can rotate about pivot point 'K' from the neutral position 'F', through position 'G' to position 'H'. FIG. 4 shows the rotation of the cradle 28 in direction 'i'. FIG. 5*a* shows the backward rotation (reclining) of the seat 36 in direction '$j_1$' and FIG. 5*b* shows the forward rotation (inclining) of the seat 36 in direction '$j_2$'. FIG. 6 shows the rotation of the backrest 44 in direction 'k'.

It is evident from a comparison of FIGS. 4 to 6 that the seat 36 and the backrest 44 are each decoupled, i.e., pivotable in a decoupled manner. By "decoupled", it is meant that the seat 36 is pivotable independently of the tilt of the cradle 28. Likewise, the backrest 44 is pivotable independently of the tilt of the cradle 28. Further, the seat 36 is pivotable independently of the backrest 44.

It is evident from FIGS. 2*a*, 2*b*, and 4 to 6 that the axis of the seat 36, pivot joint J, and the axis of the backrest 44, pivot joint K, translate together in response to a tilt of the cradle 28, because the pivot joint J and the pivot joint K are each in a fixed relationship with the cradle 28 via the upright portions 32 and the armrests 34.

However, FIGS. 2*a*, 2*b*, and 4 to 6 show that regardless of the tilt of the cradle 28, the seat 36 retains its full range of movement (tilt about joint J). Regardless of the tilt of cradle 28, the backrest 44 retains its full range of movement (tilt about joint K). The full range of movement may be referred to as "full-range tilt" for brevity. This also means that there is no fixed angular relationship between the seat 36 and the backrest 44. For instance, the backrest 44 may be inclined fully back, to a position 'H' (or 'G', or 'F'), and the seat 36 may, independently of the backrest, swivel at any angle, e.g. between positions 'D' and 'E'. Likewise, the seat 36 may be inclined at any one of positions 'C', 'D', or 'E', and the backrest 44 is free to swivel independently of the tilt of seat 36.

Figure 7B:
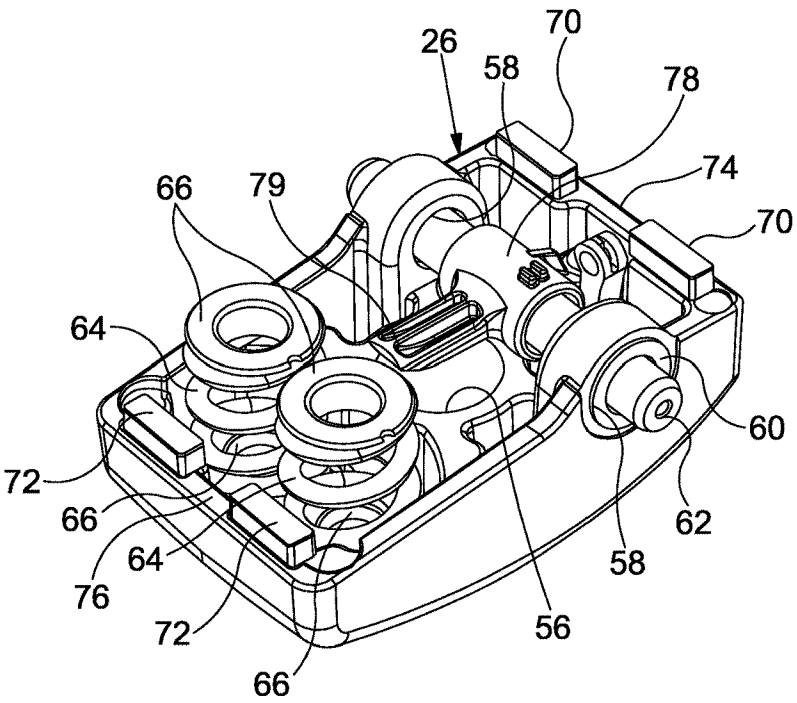
FIG. 7*b* is an open perspective view of the interior of the cradle tilt block.
Figure 7A:
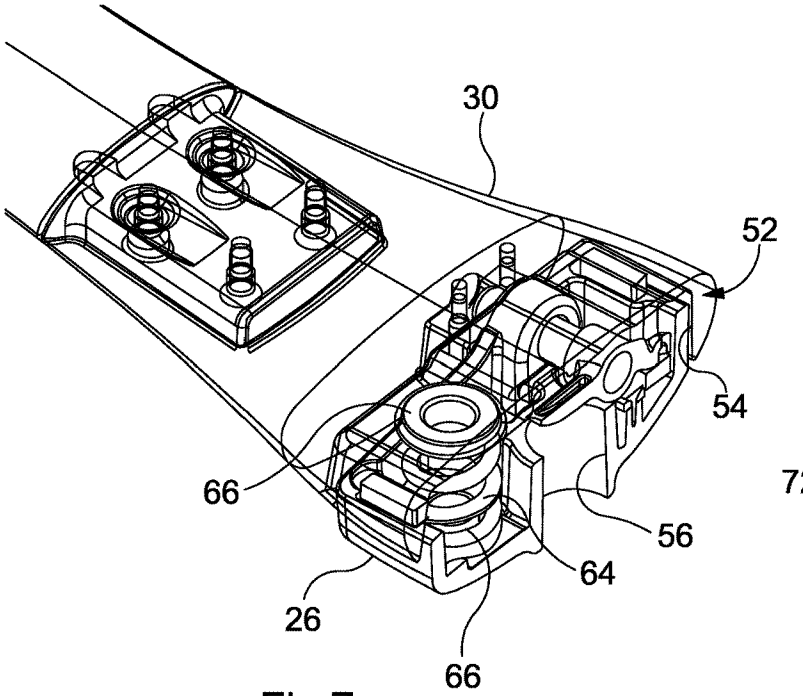
FIG. 7*a* is a transparent cross sectional perspective view through the cradle housing and cradle tilt block.
Figure 7C:
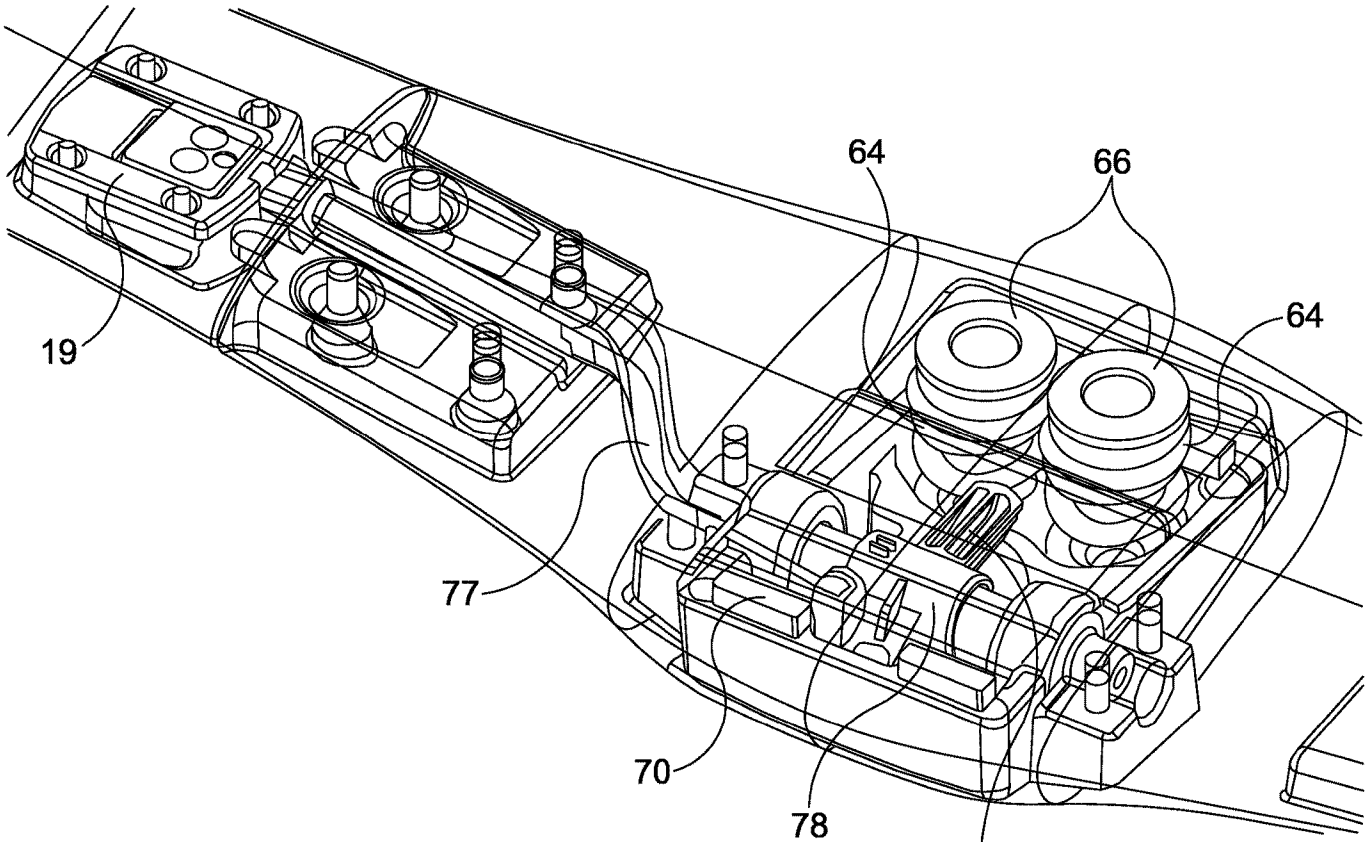
FIG. 7*c* is a transparent perspective view showing the interior of the cradle tilt block.

Referring now to FIGS. 7*a* to 7*e*, the mechanism for rotation of the cradle 28 about pivot point 'I' will now be described. (It is to be noted that part of the cradle arm 30 shown in FIGS. 7*a* and 7*c* is depicted transparently, to aid understanding of the components provided therein.)

Each cradle base arm 30 terminates in an end portion 52. Each end portion 52 is configured with a hollow portion or recess 54. When placed adjacent to each other, the recesses 54 in the ends 52 of the cradle arms 30 define a larger recess that is sized to receive the support block 26. Since the ends 52 of the cradle arms 30 meet without any discontinuity therebetween, this gives the impression that the lower part of the cradle 28 is continuous, e.g. as can be seen in FIGS. 3*b* and 3*c*. The support block 26 is secured to the cradle 28 using a bearing block 27 on each side (see FIG. 7*f*). An aperture 56 extends through the support block 26, for receiving the shaft 22 as previously described. The cradle 28 and support block 26 are preferably formed of cast aluminium.

Reducing discontinuities reduces the risk of body parts, e.g. fingers, becoming entrapped. As the ends 52 of the cradle arms 30 are received without discontinuity in the support block 26, this improves the safety of the mechanism.

The support block 26 comprises two apertures 58, in each of which is provided an annular bearing 60. An axle 62 (e.g. formed of steel) is located within the apertures 58 and is rotatable therein. Each end of the axle 62 is located within one of the end portions 52 of the cradle arm 30 so as to couple the cradle arms 30 to the support block 26 and permit relative movement therebetween. The cradle 30 can thus pivot with respect to the support block 26 which is fixed relative to the shaft 22 and base 12. The pivoting motion is dampened or regulated by two coiled steel springs 64. Bearings 66 are provided at each end of the springs 64 to help constrain the motion of the spring and reduce friction between the springs 64 and the support block 26. Four rubber buffers 70, 72 are provided on the upper surface of the support block 26, to act as movement limiters or stops. A first pair of buffers 70 is provided along a first edge 74 of the support block 26 and a second pair of buffers 72 are provided along a second edge 76 of the support block 26.

Figure 7D:
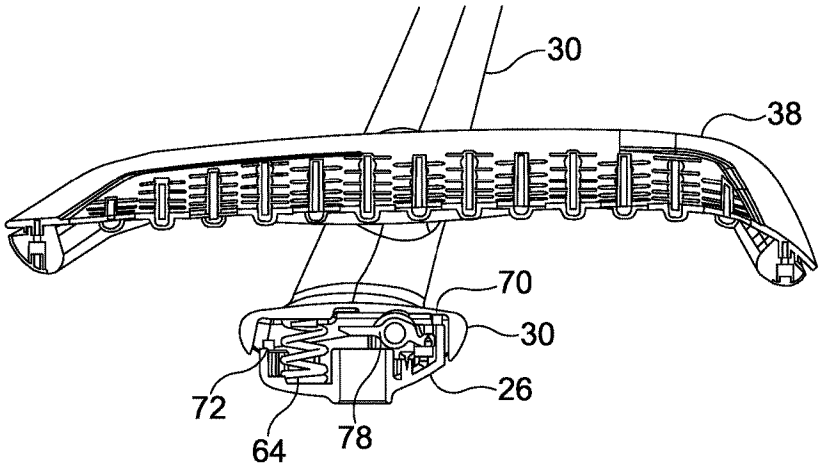
FIG. 7*d* is a cross sectional side view through the cradle tilt block at a 0° starting position.
Figure 7E:
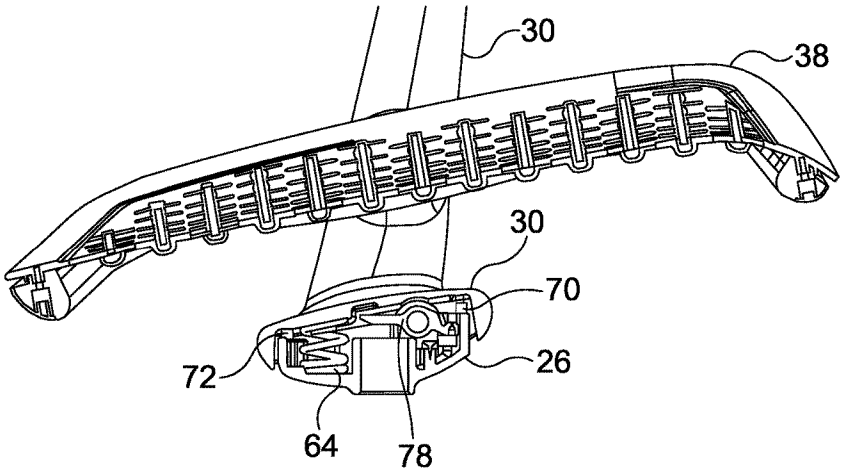
FIG. 7*e* is a cross sectional side view through the cradle tilt block at a −9° end position.
Figure 7F:
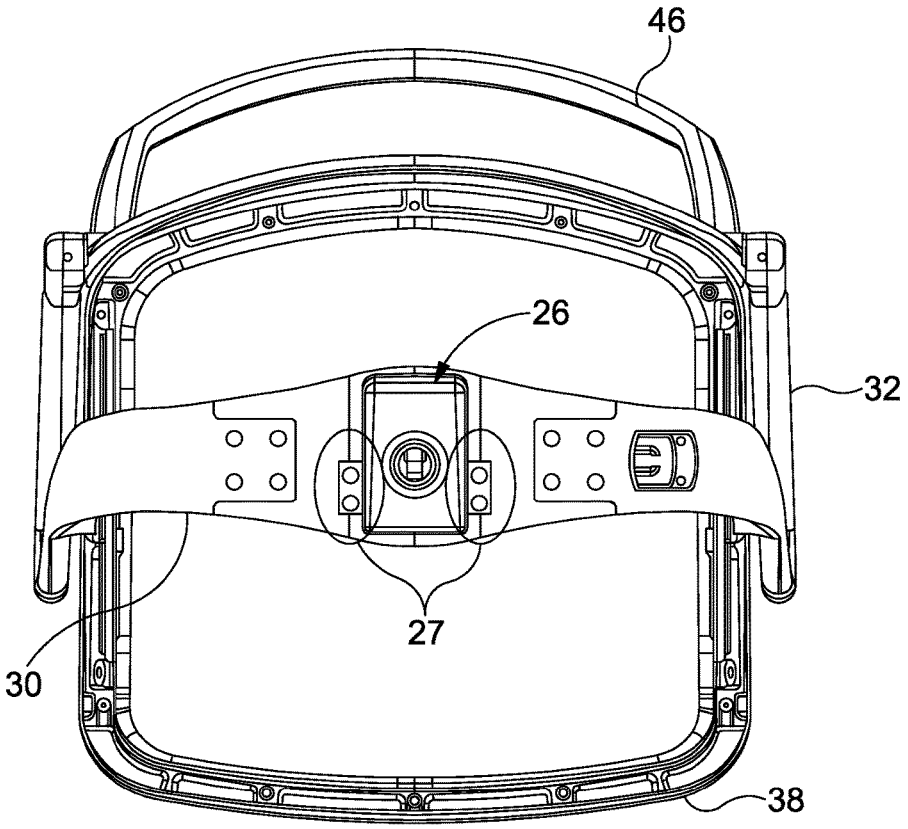
FIG. 7*f* is an underneath view of the chair.

The pivoting motion enables the cradle to move between a first position as shown in FIG. 7*d* and a second position as shown in FIG. 7*e*. FIG. 7*d* represents the cradle in a "neutral" position at substantially 0° with respect to the horizontal. In this position, the spring 64 is in an uncompressed, or primarily uncompressed state. The spring 64 thus urges the cradle end 52 away from the support block on one side of the support block (in the vicinity of the second edge 76) and the cradle end 52 is spaced from the stops 72. Due to the coupling via pivot 58, 62, this in turn forces the cradle housing end 52 on the opposite side of the support block 26 (in the vicinity of the first edge 74) into contact with the stops 70 of the support block 26. No further movement is possible and so a state of equilibrium is present.

When a user sits on the chair 10, the action of sitting down can cause the cradle 28 to tilt backwards at the pivot point 62, into the position depicted in FIG. 7*d*. This causes compression of the spring 64 and, at the maximum permitted limit, forces the cradle end 52 into contact with the stops 72. The opposite cradle end 52 is, consequentially, urged away from the stops 70. If a user were to then alight from the chair, the compression would be released from the spring 64 to urge the cradle 30 back towards the neutral position. In an embodiment, the movement from the neutral position to the position of FIG. 7*e* wherein contact with the stops 72 is achieved provides a cradle 28 tilt of approximately −9°. It will be appreciated that the chair 10 can be configured to provide for tilting at other angles, e.g. up to approximately −12° or more and e.g. approximately −11.5°, −11°, −10.5°, −10°, −9.5°, −8.5°, −8°, −7.5°, −7°, −6.5° and −6° or less. The chair 10 may also be configured such that tilting in the opposite direction (i.e. greater than 0°) is possible, to e.g. approximately 0.5°, 1°, 1.5°, 2° etc. A 'gas height release' 78 can be activated by the manual adjustment mentioned above and with reference to FIG. 7*c*. A cable 77 connects the seat height pull 19 to the gas height release 78, which activates a button 79 on the top of the inner column 22 to pneumatically adjust the height of the seat 36.

Referring now to FIGS. 8*a* to 8*f*, the mechanism by which rotation of the backrest 44 about pivot point 'J' will now be described. (It is to be noted that part of the backrest frame 46 shown in FIGS. 8*c* to 8*f* is depicted transparently, to aid understanding of the components provided therein.)

Figure 8C:
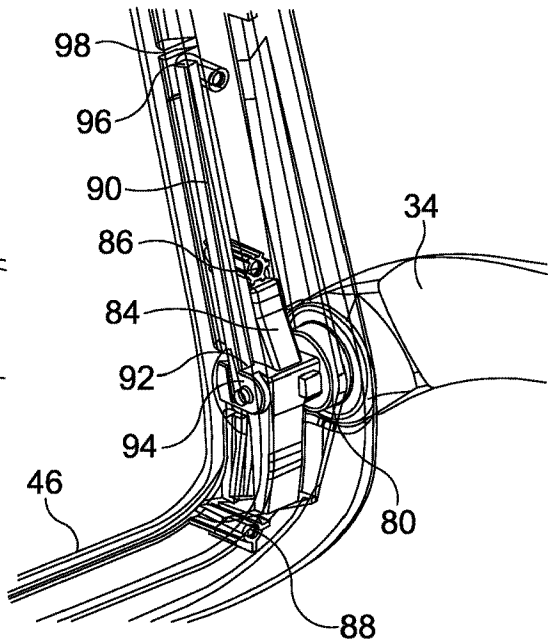
FIG. 8*c* is a transparent front perspective view through the backrest frame showing the backrest tilt mechanism.
Figure 8B:
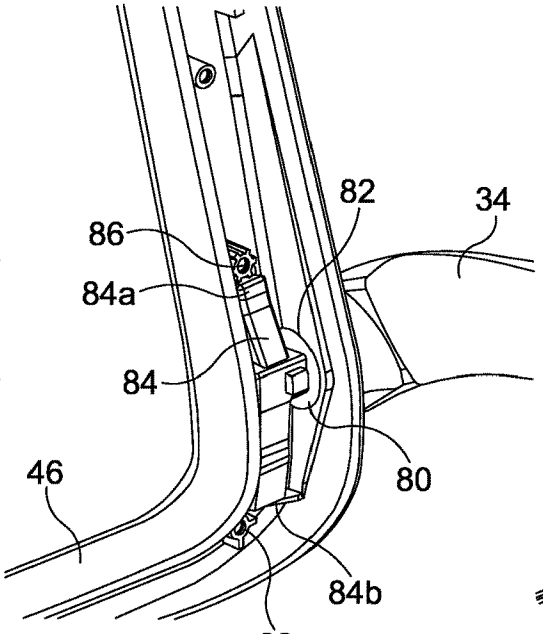
FIG. 8*b* is an open front perspective view of the interior of the backrest frame showing part of the backrest tilt mechanism.
Figure 8A:
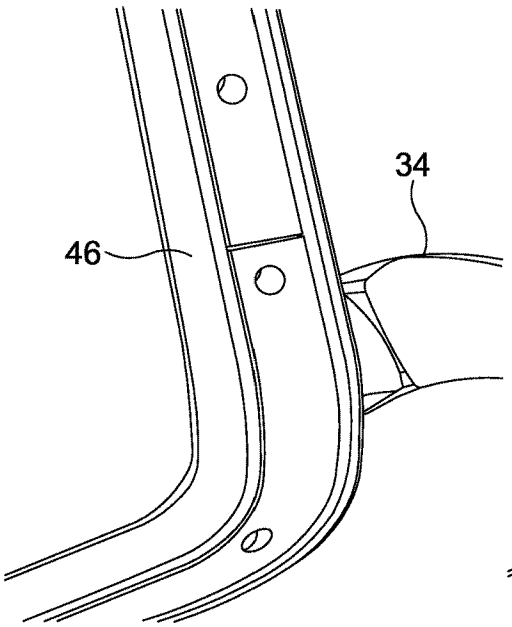
FIG. 8*a* is a front perspective view of the backrest frame/cradle connection.

FIG. 8*a* is an external view showing the portion of the backrest frame 46 where it is coupled to the armrest portion 34 of the cradle 28. The remaining FIGS. 8*b* to 8*f* show the interior of the portion of the backrest frame 44. An annular bearing 80 is secured within an aperture 82 of the armrest 34. Within the central aperture of the bearing 82 a connector 84 is provided that is fixed with respect to the armrest 34. The connector 84 may be secured within the armrest 34 with a grub screw (not visible in the Figures). The connector 84 is preferably formed of sintered steel. A first stop 86 is provided that can be brought into contact with a first end 84*a* of the connector 84. A second stop 88 is provided that can be brought into contact with a second end 84*b* of the connector 84. Movement between the stops 86 and 88 is achieved through pivoting of the backrest frame 44 with respect to the connector 84 and the armrest 34. The stops 86, 88 may be formed of glass filled nylon.

A resiliently biased component 90 is also provided with the backrest frame 44, e.g. in the form of a spring steel bar. A first end 92 thereof is received in and supported by a recess 94 in the connector 84 (as can be seen in FIG. 8*c*). The recess 94 acts as a stop or movement limiter. Movement of the opposite end 96 is limited by a stop 98.

Figure 8E:
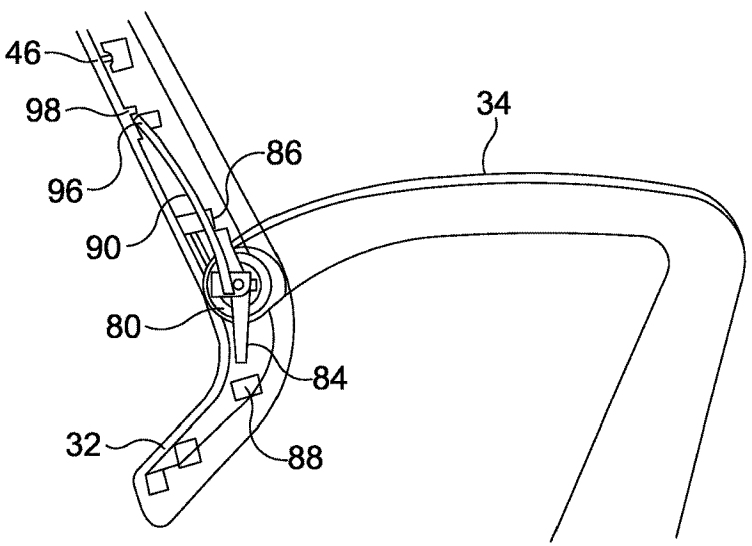
FIG. 8*e* is a cross sectional side view through the backrest frame at a −12° end position.
Figure 8D:
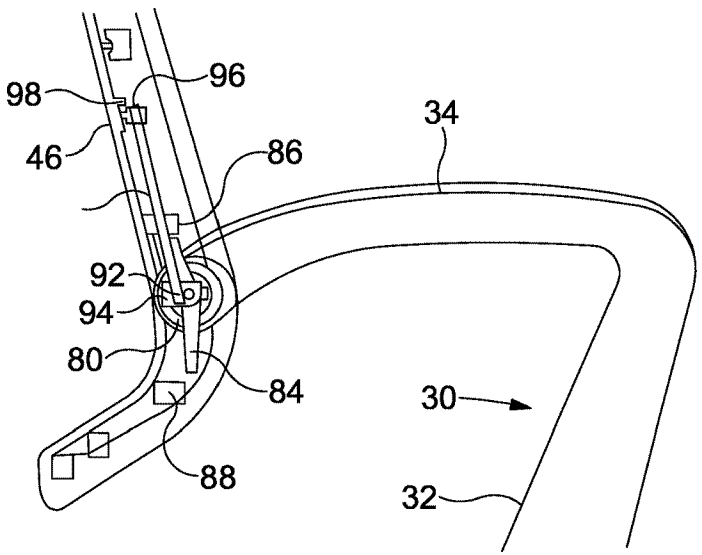
FIG. 8*d* is a cross sectional side view through the backrest frame at a 0° starting position.
Figure 8F:
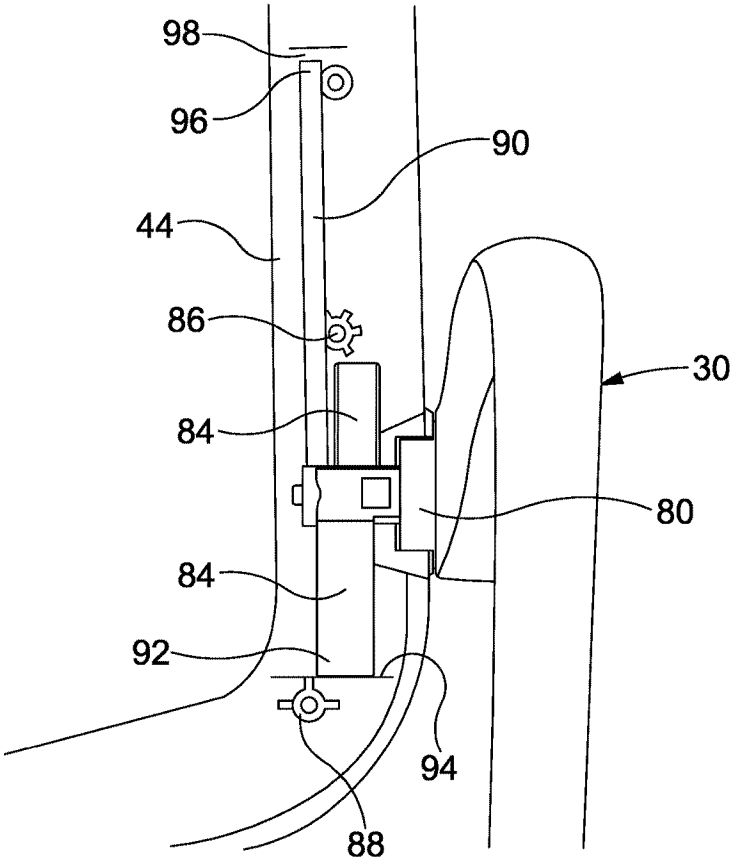
FIG. 8*f* is an open front view through the backrest at the 0° starting position of FIG. 8*d;*

FIG. 8*d* illustrates the backrest 44 at a neutral starting position. Although the backrest 44 is itself provided at a small angle with respect to the vertical in the neutral position, for reference this position is considered to be substantially 0°. Here, the spring steel bar 90 is in a substantially undeformed state when the chair 10 is not in use. When a user sits down in the chair 10, they will naturally lean back into the chair, and urge the backrest 44 backwards. The backrest 44 pivots about pivot point J, pushing the upper part of the backrest 44 backwards, away from the vertical. This causes the spring steel bar 90 to deform. The first end 92 thereof is fixed within the recess 94, but the second, free end 96 is urged towards the stop 98. Once full contact has been made, no further movement is possible. FIG. 8*e* depicts the position in which the backrest 44 is fully reclined. In a preferred embodiment this represents a declination of approximately −12° with respect to the vertical. It will be appreciated that the stop 98 may be provided at a different position within the backrest frame 44 to provide a different maximum movement limit. The range of movement may e.g. be up to approximately −15° or more, or e.g. −14.5°, −14°, −13.5°, −13°, −12.5°, −11.5°, −11°, −10.5°, 10°, −9.5° or −9° or less. The chair 10 may also be configured such that tilting in the opposite direction (i.e. greater than 0°) is possible, to e.g. approximately 0.5°, 1°, 1.5°, 2° etc.

Referring now to FIGS. 9*a* to 9*f*, the mechanism by which rotation of the seat 36 about pivot point 'K' will now be described. (It is to be noted that part of the seat frame 38 shown in FIGS. 9*b* to 9*f* is depicted transparently, to aid understanding of the components provided therein.)

Figure 9A:
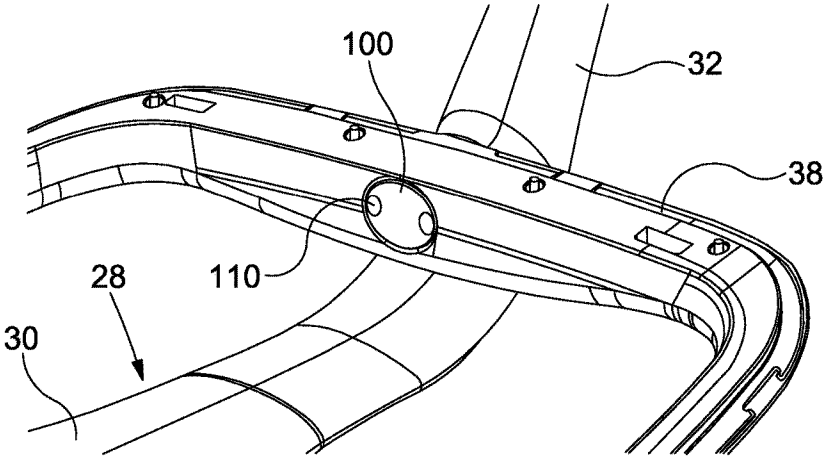
FIG. 9*a* is a perspective view of the seat frame/cradle connection.
Figure 9B:
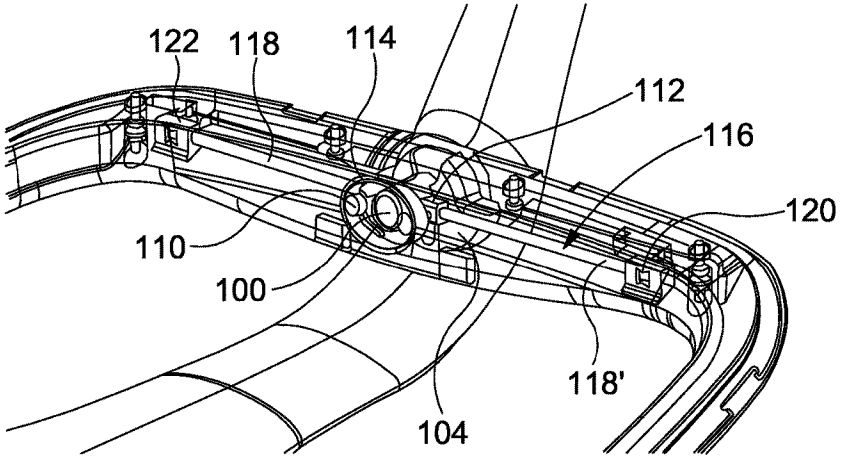
FIG. 9*b* is a transparent perspective view of the seat frame/cradle connection.

FIG. 9*a* is an external view showing the portion of the seat frame 36 where it is coupled to the upright portion 32 of the cradle 28. The remaining FIGS. 9*b* to 9*f* show the interior of the portion of the seat frame 36. A connector 100 couples the seat frame 38 to the cradle 28. As is visible in FIG. 9*f*, the connector 100 comprises a shaft 102 receivable within a bearing 104 provided within an aperture 106 of the cradle 28. A cap 108 helps to secure, via fastenings 110, the connector 100 in place and provide a continuous/flush surface within the seat frame 36.

The connector 100 further comprises a housing 112. A resiliently biased component such as a spring steel bar 116 is passed through and is supported by the housing 112 approximately half way along its length. A first end of the spring steel bar 116 is received and fixed within a recess 120 provided within the seat frame 44. A second and opposite end of the spring steel bar 116 is received and fixed within a recess 122 provided within the seat frame 44. As such, a first portion 118 of the spring steel bar 116 is located on one side of the housing 112, and a second portion 118' of the spring steel bar 116 is located on the other side thereof. The bearing 104 is configured with first and second bearing surfaces 124, 126. The seat frame 44 comprises first and second stop surfaces 128, 130 respectively configured to abut the first and second bearing surfaces at first and second movement limits as will now be described.

Figure 9C:
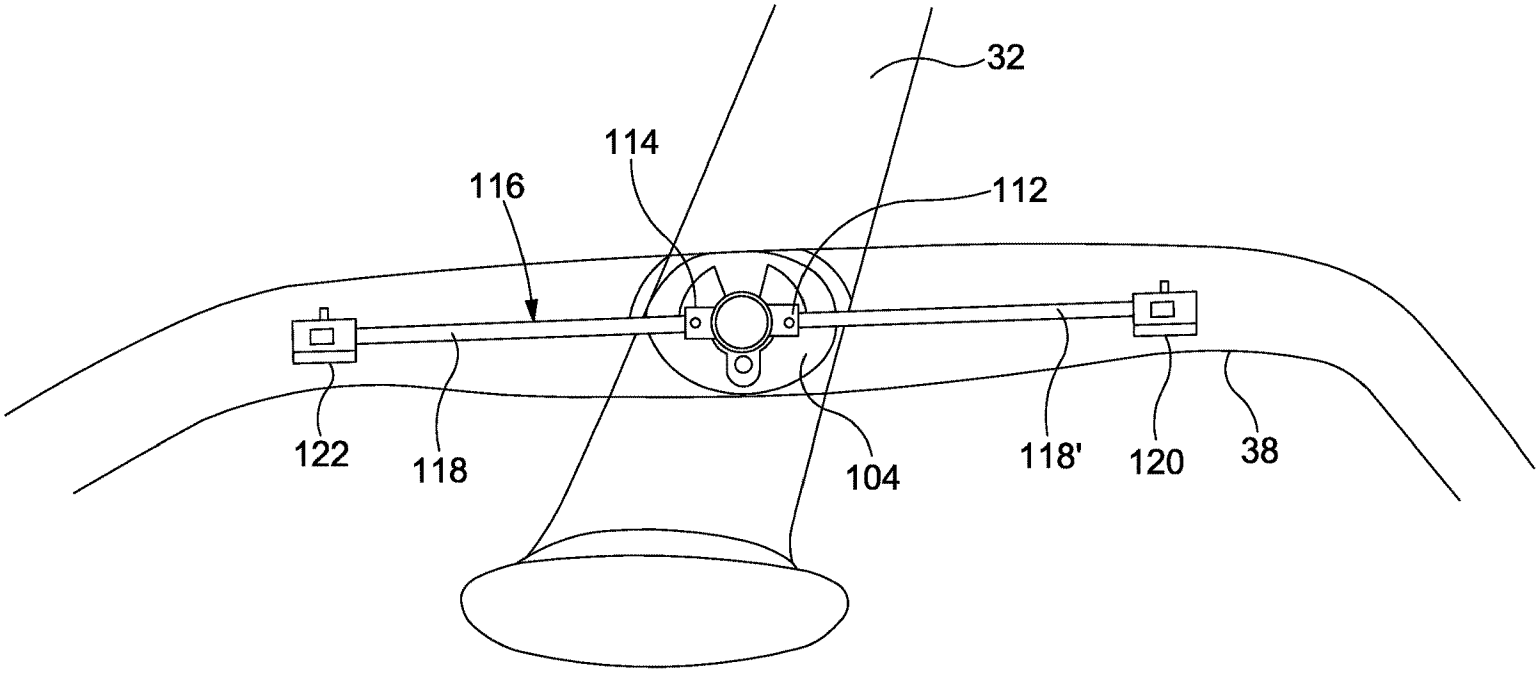
FIG. 9*c* is an inner side view of the seat frame/cradle connection at a 0° starting position.
Figure 9D:
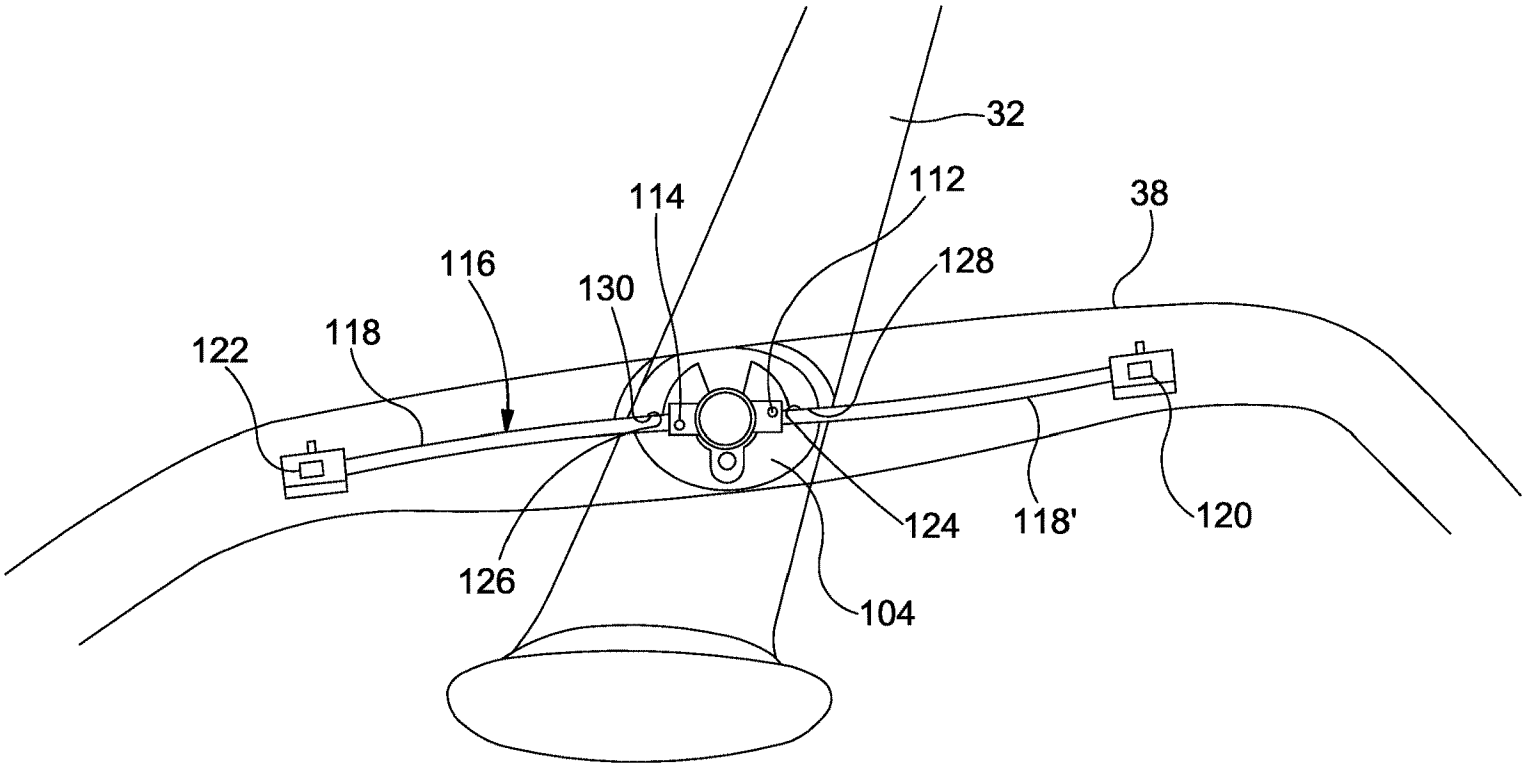
FIG. 9*d* is an inner side view of the seat frame/cradle connection at a 5° stop position.
Figure 9E:
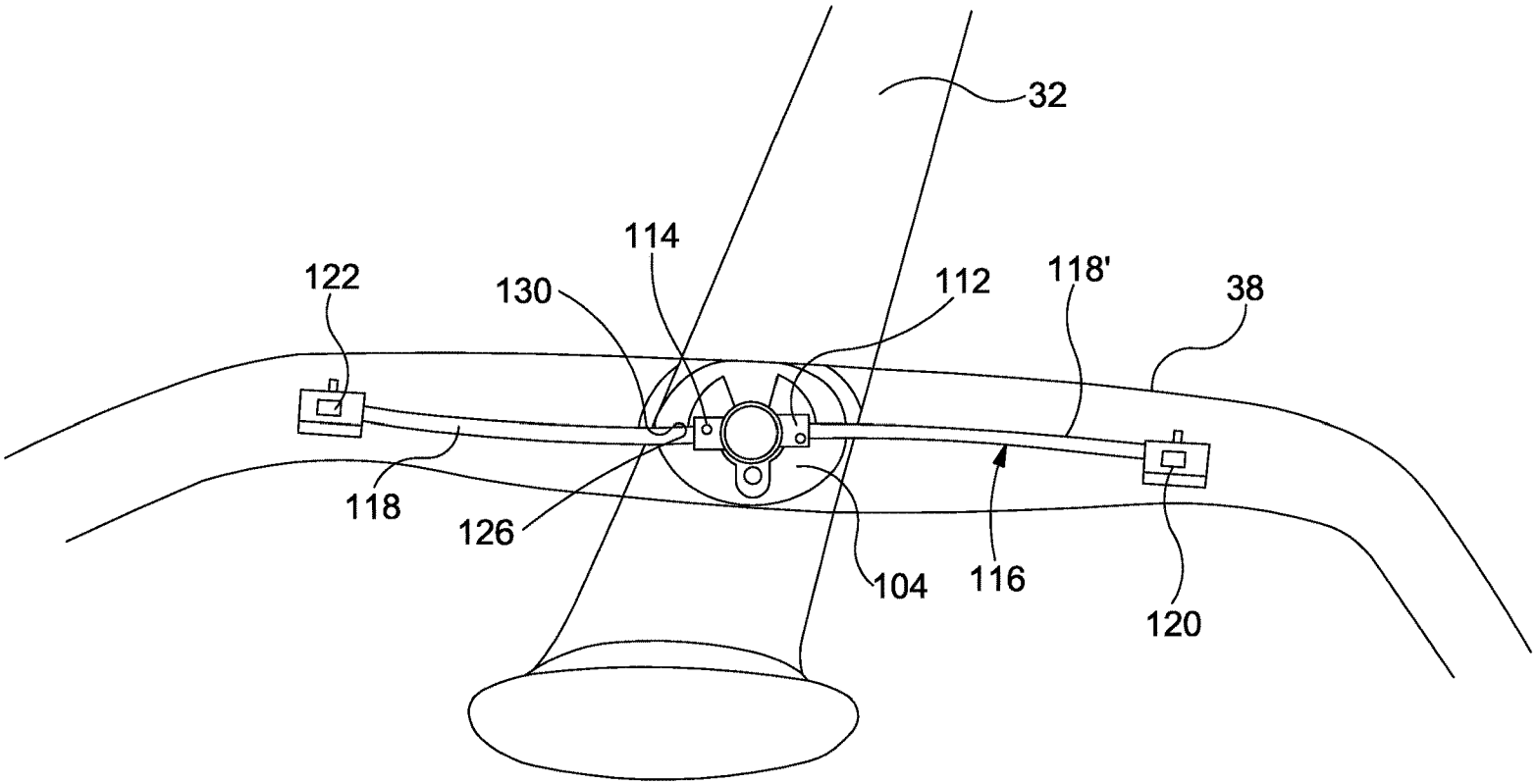
FIG. 9*e* is an inner side view of the seat frame/cradle connection at a −5° stop position.
Figure 9F:
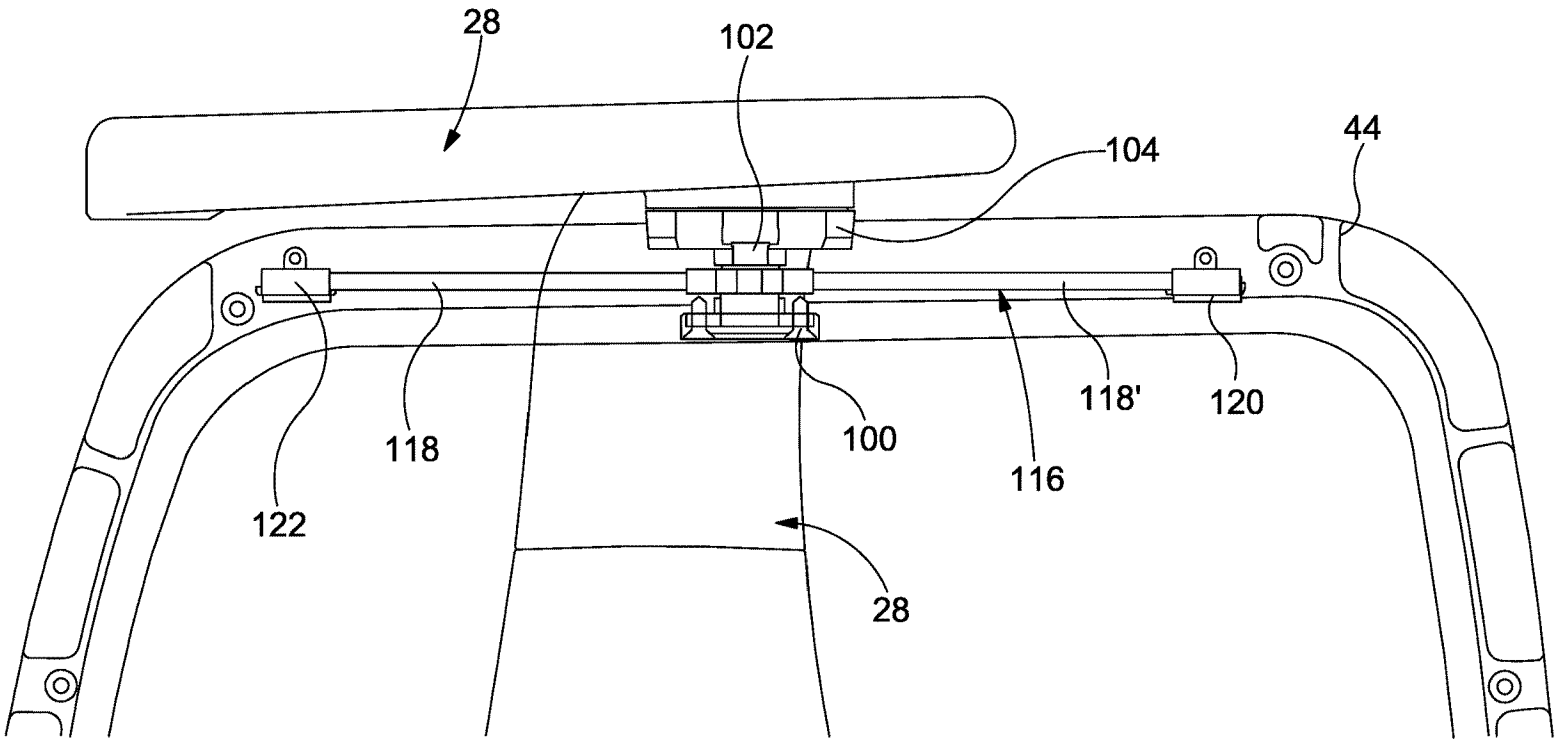
FIG. 9*f* is a top view of the seat frame/cradle connection at the 0° starting position.

FIG. 9*c* shows the seat at a neutral (0°) starting position where both portions of the spring steel bar 118, 118' are substantially undeformed. FIG. 9*d* illustrates the seat frame 38 rotated in a first direction with respect to pivot point K. Here, the first stop surface 128 of the seat frame 38 contacts the first bearing surface 124 to prevent or at least limit further movement in the positive direction. FIG. 9*e* illustrates the seat frame 38 rotated by in a second direction with respect to pivot point K. Here, the second stop surface 130 of the seat frame 38 contacts the second bearing surface 126 to prevent or at least limit further movement in the negative direction. In each case, the spring steel bar 116 is caused to deform, as can be seen from the displacement of the spring steel bar portions 118, 118' visible in FIGS. 9*d* and 9*e* away from their neutral positions, which provides a dampening effect.

In a preferred embodiment, the bearing 14 and seat frame 38 are configured such that the stops 128, 130 provide a rotation with respect to pivot point K of approximately 5° in each direction with respect to the horizontal. It will be appreciated that the bearing surfaces 124, 126 and the stop surfaces 128, 130 may be configured (e.g. by altering the angle, position, size thereof) to provide a different maximum movement limit. The range of movement may e.g. be up to approximately ±8° or more, or e.g. ±7.5°, ±7°, ±6.5°, ±6°, ±5.5°, ±4.5°, ±4°, or ±3° or less. The chair 10 may also be configured such that tilting in one direction only is permitted.

Embodiments of the present invention advantageously create a fully dynamic chair 10, which tilts, turns and fully supports an anthropometrically broad range of users, but which is more intuitive, eliminating the need for manual adjustment by the user. A chair 10 according to embodiments of the present invention would lend itself to the modern workplace, where people can be sat in several different places and on several different chairs each day, by taking away the time-consuming requirement to 'set-up' the chair to suit a particular user, therefore making the need for training redundant, which can be currently a costly part of each employer's duty-of-care. Advantageously embodiments of the invention provide a combination of features that provides for seat, back and tilting movement without the need for manual adjustment.

An embodiment of a chair 10 according to the present invention has undergone an ergonomics assessment. The seat height was adjusted so that all the users were able to sit on the chair with their feet flat on the floor (no undue pressure at the back of knees). The ergonomics assessment consisted of 10 people (4 females and 6 males) with varying stature from 5th to 95th centile UK population sitting on the chair which was part of a rig. Subjects sat on a pressure map on the seat pad 40 and backrest 44 and their pressure profiles were recorded.

As the backrest 44 comprises a mesh back 48 without a lumbar device, in order to determine how well the mesh deforms whilst still providing good lumbar support automatically for different sizes of people, the spines of the test subjects were traced when they were standing, when they are sitting on a box in a relaxed (semi-slouched) posture and when leaning back on the mesh backrest 48. The working assumption was that if the mesh back 48 gives a good support and automatically adjusts to the user's back, the tracing of their spines when seated in the chair 10 should be more like the shape of standing posture, not like the sitting slouched posture.

In addition users were questioned about the overall feel and comfort of the chair, and their likes and dislikes about the chair. Users were asked about levels of discomfort experienced at different parts of their body. Discomfort assessment is used as physiologically people have discomfort (pain) sensors not comfort sensors.

Preliminary measurements of the chair 10 in the rig gave the following approximate dimensions:

Seat pad depth: 450 mm
Seat pad width: 495 mm
Backrest width: 485 mm
Seat pad angle: approximately −5° to +5°
Angle of backrest relative to vertical: −9°

Dimensionally most of the test subjects were happy with the dimensions of the chair 10, and it was possible to obtain a correct seat height for each user by adjusting the seat height. It was found that the seat depth was appropriate to cover the range of users of different heights and stature and any significant departure therefrom could potentially be to the detriment of some users.

Analysis of the pressure mapping of the backrest 44 and the spinal tracing showed that the mesh back 48 sufficiently deforms and adapts the back of the user and provides adequate support around the lumbar area. Responses of the users supported this, in a way that they all felt a good lumbar support. In most instances, spinal tracing showed the lumbar protrusion of the curve, but there was no evidence of slouching from any of the users. Pressure mapping of the users' backs also showed the support around the lumbar.

Pressure distribution of the seat pad 40 was generally good—only a couple of traces showed high pressure points and only one user felt some awareness of firmness under their pelvis.

Users found the resistance of backrest to pivot was about right—no user found it to be too strong or too weak.

In conclusion, the concept of a pivoting backrest 44 and pivoting seat pad 36 is beneficial to a user in terms of encouraging dynamic sitting. Having only a pivoting backrest is not sufficient. A pivoting seat pad 36 additionally allows a user to automatically open up the angle between their thighs and torso. This not only improves the user's breathing, and hence the blood supply to the brain (keeping them alert and more productive), but also helps them to exercise their core muscles which can help towards avoiding back pain and discomfort.

The independent full-range tilt of the seat 36 and backrest 44 relative to the cradle 28 permits the chair to compensate for micro-movements of a person sitting in it. For instance, a person may sit upright at a desk and momentarily stretch their feet. The seat 36, being independently swivelable, is able to swivel forward in response to the more inclined angle of the upper thighs and continue to support the upper thighs without the seat's forward edge pressing into the underside of the thighs. Upon bending the legs back to an upright sitting position, the tilt of seat 36 follows the angle of the upper thighs and returns to a more horizontal attitude. The responsiveness and range of the seat 36 is independent of the tilt of the cradle 28 or the backrest 44. This provides a continuously responsive, adaptive chair configuration that by some test persons has been described as "fluidic", without requiring a user to manually adjust a seat or backrest.

The invention claimed is:

1. A chair comprising:

a backrest;

a seat comprising a pair of recesses;

a supporting structure for supporting at least one of the backrest and the seat;

a base support, wherein the supporting structure, the seat and the backrest are each pivotably mounted relative to each other and relative to the base support to permit the supporting structure, the seat and the backrest to each tilt over a predetermined range, to allow the chair to move into and out of a reclined position, and wherein the seat is free to pivot over its predetermined range relative to the supporting structure independently of a tilt of the supporting structure;

a connector pivotably interconnecting the seat with the supporting structure for rotation about a seat tilting axis, wherein the connector comprises a shaft fixed to the seat and rotatably received within a bearing fixed to the supporting structure to define the seat tilting axis, a housing supported on the shaft, and first and second bearing surfaces on the bearing; and at least one elongate leaf or rod spring element having longitudinal ends fixed in respective ones of the recesses, the elongate leaf or rod spring element extending lengthwise transverse to the seat tilting axis at a location between the longitudinal ends, wherein at least one of the housing and the elongate leaf or rod spring element comprises at least one stop surface for contacting the first bearing surface when the seat is at a first limit at least in part defining the predetermined range of tilt of the seat.

2. The chair of claim 1, wherein backrest is free to pivot over its predetermined range relative to the supporting structure independently of a tilt of the supporting structure.

3. The chair of claim 1, wherein the supporting structure is pivotably mounted with respect to the base support, the seat is pivotably mounted with respect to the supporting structure and the backrest is pivotably mounted with respect to the supporting structure.

4. The chair of claim 1, further comprising a seat tilt mechanism that permits the seat to pivot about a pivot point and with respect to the base support such that the seat is tiltable between the first limit in a first direction and a second limit in a second and opposite direction, the first limit and the second limit defining the predetermined range of the tilt of the seat.

5. The chair of claim 4, wherein the elongate leaf or rod spring element is for regulating the motion and return of the seat during tilting.

6. The chair of claim 5, wherein the elongate leaf or rod spring element comprises a resiliently deformable component that is deformable when the seat is tilted in at least one direction.

7. The chair of claim 6, wherein the elongate leaf or rod spring element comprises at least one of a spring steel member, a spring, and an elastomeric member.

8. The chair of claim 4, wherein the first and second limits are defined by stop positions on the supporting structure.

9. The chair of claim 8, wherein the seat is tiltable from a neutral position at 0° to the first limit of approximately +5° and to the second limit of approximately −5°.

10. The chair of claim 1, further comprising a backrest tilt mechanism that permits the backrest to pivot about a pivot point with respect to the supporting structure such that the backrest is tiltable between a first backrest limit in a first direction and a second backrest limit in a second and opposite direction, the first backrest limit and the second backrest limit defining the predetermined range of the tilt of the backrest.

11. The chair of claim 10, wherein the backrest tilt mechanism comprises a component for regulating the motion and return of the backrest during tilting.

12. The chair of claim 11, wherein the component comprises one of a pretensioned and a resiliently deformable component that is deformable when the backrest is tilted in at least one direction.

13. The chair of claim 12, wherein the component comprises at least one of a spring steel member, a spring, an elastomeric member, and a hydraulic dampener.

14. The chair of claim 10, wherein the first and second backrest limits are defined by stop positions on the supporting structure.

15. The chair of claim 10, wherein the backrest is tiltable from a neutral position to the first limit of approximately −12°.

16. The chair of claim 1, further comprising a supporting structure tilt mechanism that permits the supporting structure to pivot about a pivot point with respect to the base support such that the supporting structure is tiltable between a first supporting structure limit in a first direction and a second supporting structure limit in a second and opposite direction, the first supporting structure limit and the second supporting structure limit defining the predetermined range of the tilt of the supporting structure.

17. The chair of claim 16, wherein the tilt mechanism comprises a component for regulating the motion and return of the supporting structure during tilting.

18. The chair of claim 17, wherein the component comprises one of a pretensioned and a resiliently deformable component that is deformable when the supporting structure is tilted in at least one direction.

19. The chair of claim 1, wherein the first and second supporting structure limits are defined by at least one buffer provided within the supporting structure tilt mechanism.

20. The chair of claim 1, wherein the supporting structure is tiltable from a neutral position to the first limit of approximately −9°.

* * * * *